US005690848A

United States Patent [19]

Lamberti

[11] Patent Number: 5,690,848

[45] Date of Patent: Nov. 25, 1997

[54] SUCTION HOOD WITH INTEGRATED GRILL

[76] Inventor: Silvano Lamberti, Via Galli 49, Gussago (Brescia), Italy

[21] Appl. No.: 507,817

[22] Filed: Jul. 27, 1995

[30] Foreign Application Priority Data

Dec. 6, 1994 [IT] Italy ..... BS94A0144

[51] Int. Cl.[6] ..... H05B 3/68; F24C 15/20

[52] U.S. Cl. ..... 219/444; 126/299 R

[58] Field of Search ..... 219/444, 403, 219/404, 407; 126/299 R, 299 D, 38, 37 R, 37 B

[56] References Cited

U.S. PATENT DOCUMENTS 3,387,434 6/1968 Stalker ..... 129/299 D 3,598,962 8/1971 Badnaruk ..... 219/444

4,766,881 8/1988 Pax ..... 126/299 R

*Primary Examiner*—Teresa J. Walberg

*Assistant Examiner*—Sam Paik

*Attorney, Agent, or Firm*—McGlew and Tuttle

[57] ABSTRACT

A suction hood for cookers integrated with an electric which can be moved between a horizontal position for use and a vertical position for folding away. The grill, in its horizontal position for use, being parallel, underneath and at a short distance from the hood, whereas it is concealed behind the hood when folded away. The hood and grill have a single electric power supply and the grill bears a tray, a grid and removable heating elements.

8 Claims, 2 Drawing Sheets

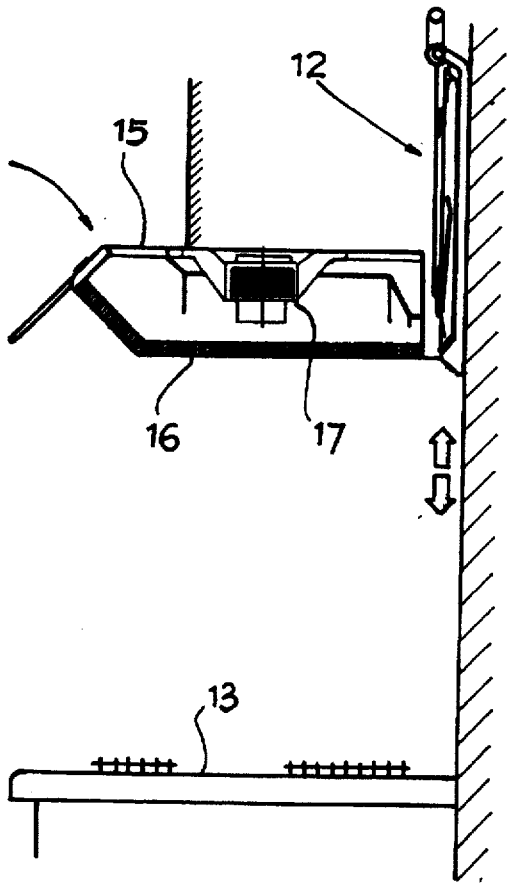
Fig. 5
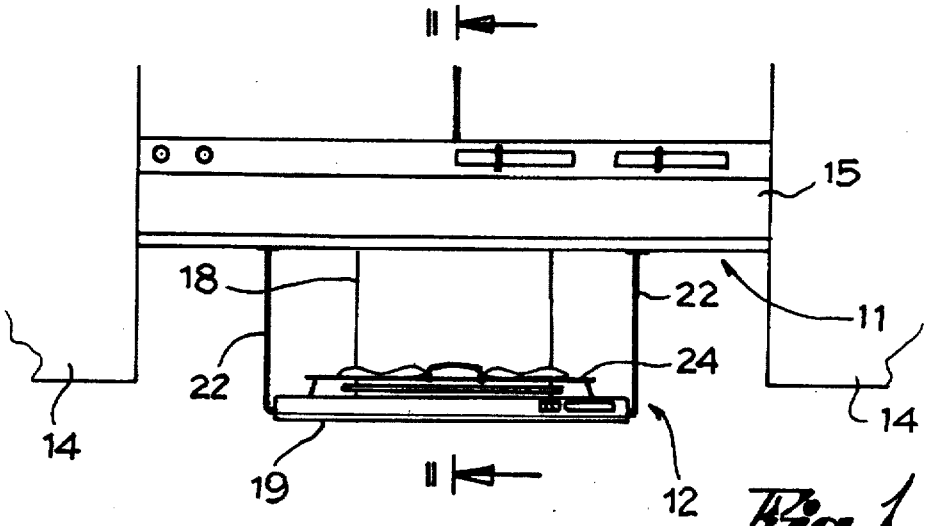
Fig. 1
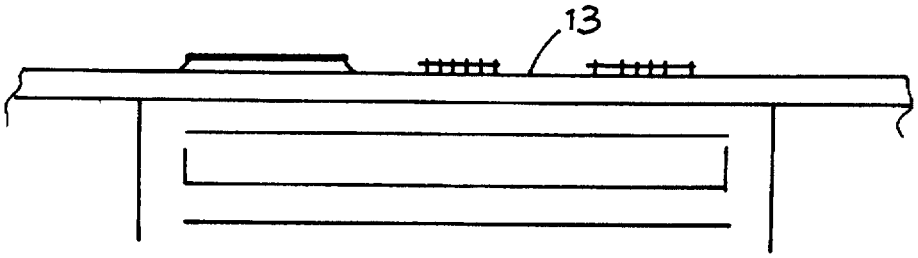

SUCTION HOOD WITH INTEGRATED GRILL

FIELD OF THE INVENTION

The present invention relates to a suction hood for cookers and more specifically a suction hood with an integrated grill.

On the one hand, suction hoods used in kitchens normally perform the sole function they are designed for. A relative electric wiring harness is only used to power the suction appliance and the lighting device with which they are fitted. Moreover, in the framework of a suction hood there is always space available that till now has not been used.

On the other hand, there are also electric grills known, which are more commonly used outside the kitchen, generally outdoors due to the vapours and fumes produced while cooking food. These grills have their own wiring harness for electric power supply.

SUMMARY AND OBJECTS OF THE INVENTION

It is an object of the present invention to produce a composite appliance combining a suction hood and an electric grill located above the hob, each of which keeps its own run, on, both integrated through a single electric wiring harness system.

According to the invention, the suction hood arrangement for cookers is provided, including an electric grill integrated with the suction hood. The grill is connected with means for moving the grill between a horizontal position for use and a vertical position for folding away. The grill, in its horizontal position of use, is parallel to the suction hood, underneath the suction hood and spaced a short distance away from the suction hood. In the folded-away position, the electric grill is concealed behind the suction hood.

The appliance proposed herein permits achievement of at least the following advantages:

- two electrical devices in a single space which is generally scarcely used;
- use of a single electric power supply for both functions: suction hood and grill, with the controls preferably located on the hood only, so as to permit removal of the grill components, including the electric heating elements, for cleaning;
- use of a fold-away grill, i.e. which can be concealed behind the hood when not in use;
- extraction of fumes and vapours directly close to the grill when in use;
- consequently use of the grill in a closed room;
- use of the same lighting for the grill provided with the hood; and
- possibly of using the hob at the same time as the grill.

BRIEF DESCRIPTION OF THE DRAWINGS

The accompanying drawings illustrate schematically and by way of example a preferred embodiment of the invention, in which:

FIG. 1 is a front view of the hood and grill with the latter in its position of use;

FIG. 5 is a cross-sectional view of the grill folded away and concealed behind the hood.

DETAILED DESCRIPTION OF THE PREFERRED EMBODIMENT

Figure 2:
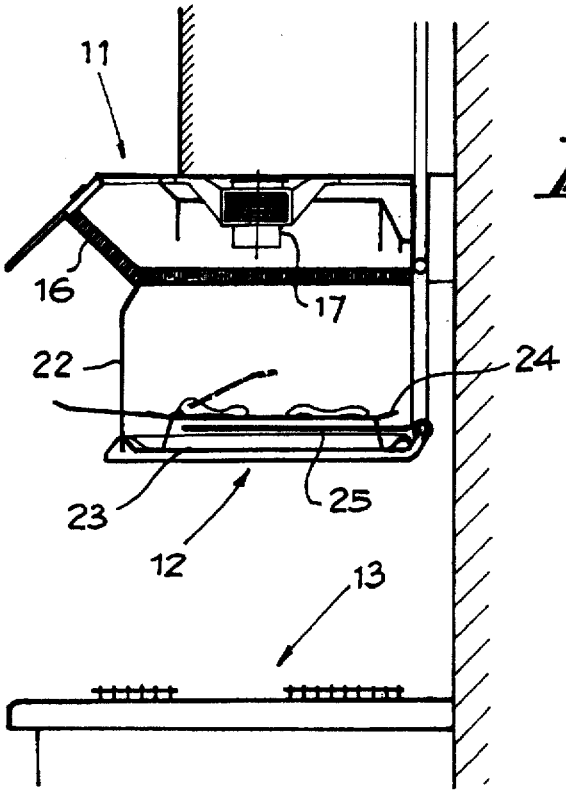
FIG. 2 is a cross-sectional view according to line II—II in FIG. 1.

In said drawings, the suction hood is indicated as a whole with reference numeral 11 and the grill is indicated with 12.

The suction hood 11 is installed in a known manner over the cooker hob 13 in the framework of kitchen wall units 14. It comprises a box 15 containing a filtering unit 16 and a suction unit 17.

The grill 12 is of electric type and can be moved between a position of use, at an intermediate level between the cooker hob range 13 and the suction hood 11, and a folded away and concealed position, behind the hood. The grill 12 comprises an arm or panel 18 with a vertical arrangement and a supporting surface 19 which is hinged, at 20, to the bottom portion of said arm or panel 18. The latter is slidingly fitted on vertical guides 21 provided, for example, on the back of the box 15 of the suction hood 11. The supporting surface 19, hinged at 20, can be tilted horizontally to use the grill and vertically, in line with the arm or panel 18, to fold away the grill. The supporting surface 19 comprises means to keep it in the horizontal position. In the example illustrated, these means comprise rods or tie-rods 22 that can be hooked in any manner to the box of the hood.

The supporting surface 19 is suitable to bear a bottom tray 23, a grid 24 and electric heating elements 25, all applicable components in a removal form to allow removal for cleaning and washing in general Advantageously, the hood and the grill can be connected to the electric mains by means of a single electric cable, therefore with a single wiring harness. To control the hood and the grill independent switches 26, 27 may be provided on the box of the hood or separately on the hood and on the grill.

Figure 3:
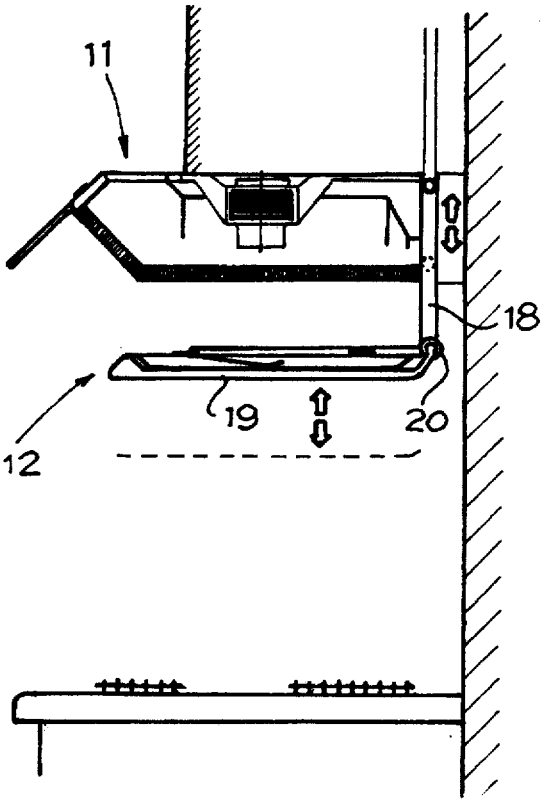
FIGS. 3 and 4 are similar cross-sectional views to those in FIG. 2, but with the grill in two intermediate positions: of folding away and folding out.
Figure 4:
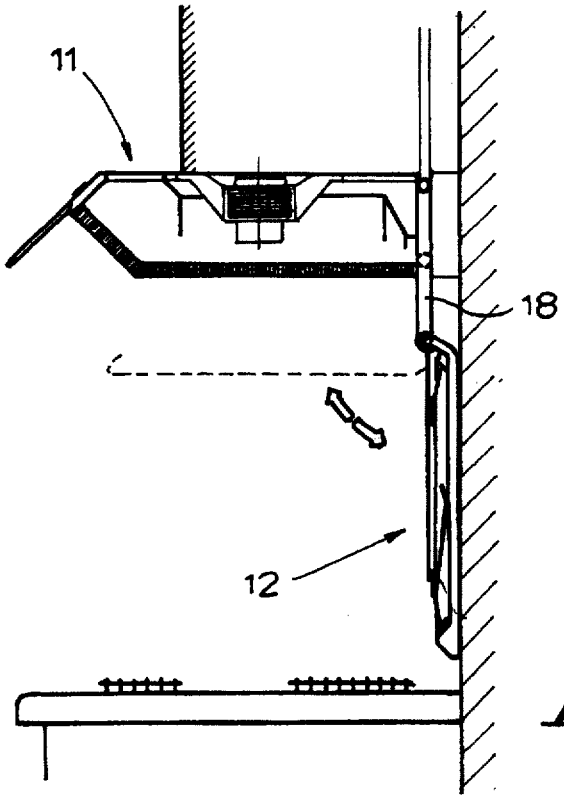

In any case, when the grill is not in use, it can be slid and concealed behind the hood as shown in FIG. 5. It then takes up no room which may limit or obstruct normal use of the cooker hob range and of the hood. When necessary, the grill is slid out from behind the hood with movements schematized by continuous and broken lines, as well as by the arrows in FIGS. 3 and 4, so as to arrange and support the supporting surface of the grill n its horizontal position as shown in FIGS. 1 and 2. Then the grill 12 complete with its functional elements will be at an intermediate height between the cooker hob 13 and the hood for easy use of and access to the grill without moreover preventing use of the cooker hob range at the same time.

The hood will be over the grill so as to extract fumes and vapours given off while grilling food. The grill is folded away after use with opposite movements to those of sliding it out, and the grill folded away can be housed in a compartment behind the hood—see FIG. 5—which can preferably be closed with a door to conceal the grill.

While a specific embodiment of the invention has been shown and described in detail to illustrate the application of the principles of the invention, it will be understood that the invention may be embodied otherwise without departing from such principles.

I claim:

1. A suction hood arrangement for cookers, comprising:

a suction hood;

an electric grill;

support means connecting said electric grill to said suction hood for integrating the electric grill and suction hood, said support means including means for supporting the electric grill in a horizontal position for use, said horizontal position being parallel to said suction hood, and positioned underneath said suction hood, spaced a short distance from said suction hood and means for moving said electric grill from said horizontal position for use to a folded-away position, concealed behind said suction hood.

2. A device according to claim 1, wherein said support means includes means for moving said electric grill in height with respect to said hood.

3. A suction hood according claim 1, further comprising electric power supply means, including control switches located on said hood, said power supply means being supplied with power from a single electric power supply cable.

4. A suction hood according to claim 1, wherein said support means comprises an arm with a vertical arrangement, said arm having a bottom portion, a supporting surface hinged onto said bottom portion of said arm, said supporting surface being movable from said horizontal position for use to said vertical position for folding away and vertical guides, said arms sliding along said vertical guides, said supporting surface being positioned and held horizontally by fixing means for fixing said supporting surface to said arm.

5. A suction hood according to claim 1, wherein said support means comprises an panel with a vertical arrangement, a supporting surface hinged onto said bottom portion of said panel, said supporting surface being movable from said horizontal position for use to said vertical position for folding away and vertical guides, said panels sliding along said vertical guides, said supporting surface being positioned and held horizontally by fixing means for fixing said supporting surface to said panel.

6. A suction hood according to claim 4, wherein said supporting surface of said electric grill includes a tray, a grid, and electrical heating elements, each of said tray, grid and electrical heating elements being removable from said supporting surface.

7. A suction hood according to claim 1, wherein a compartment is defined behind said suction hood, said electric grill being folded away and concealed in said compartment in said vertical position.

8. A suction hood according claim 1, further comprising electric power supply means, including control switches located on said grill, said power supply means being supplied with power from a single electric power supply cable.

* * * * *